US009908677B2

(12) United States Patent
Shi et al.

(10) Patent No.: US 9,908,677 B2
(45) **Date of Patent: *Mar. 6, 2018**

(54) PACKAGE HAVING UNITARY BODY INCLUDING A BREAK-OFF CAP

(71) Applicant: Colgate-Palmolive Company, New York, NY (US)

(72) Inventors: Yu Shi, Branchburg, NJ (US); Derek Michael Samaroo, Edison, NJ (US); Jun Wang, Fort Washington, PA (US); Christopher Joseph Miller, Flemington, NJ (US); Devesh Badola, Mumbai (IN); Kai Wang, Guangdong (CN); Sandeep Thombre, Maharashtra (IN); Alok Agashe, Maharashtra (IN)

(73) Assignee: Colgate-Palmolive Company, New York, NY (US)

( * ) Notice: Subject to any disclaimer, the term of this patent is extended or adjusted under 35 U.S.C. 154(b) by 254 days.

This patent is subject to a terminal disclaimer.

(21) Appl. No.: 14/414,204

(22) PCT Filed: Jul. 11, 2013

(86) PCT No.: PCT/US2013/050076
§ 371 (c)(1),
(2) Date: Jan. 12, 2015

(87) PCT Pub. No.: WO2014/011880
PCT Pub. Date: Jan. 16, 2014

(65) Prior Publication Data

US 2015/0151891 A1 Jun. 4, 2015

(30) Foreign Application Priority Data

Jul. 12, 2012 (IN) ..... 2161/DEL/2012

(51) Int. Cl.
*B65D 35/00* (2006.01)
*B65D 75/58* (2006.01)
(Continued)

(52) U.S. Cl.
CPC ..... *B65D 75/5811* (2013.01); *B65D 1/095* (2013.01); *B65D 35/08* (2013.01);
(Continued)

(58) Field of Classification Search
CPC ..... B65D 1/095; B65D 35/08; B65D 35/14; B65D 75/30; B65D 75/322; B65D 75/323;
(Continued)

(56) References Cited

U.S. PATENT DOCUMENTS 2,663,461 A 12/1953 Brown
3,204,835 A * 9/1965 Michel ..... B65D 1/0238 215/43
(Continued)

FOREIGN PATENT DOCUMENTS

WO WO 9417980 8/1994
WO WO1997/29975 8/1997
WO WO2010/013106 2/2010

OTHER PUBLICATIONS

The International Search Report and the Written Opinion of the International Searching Authority issued in International Application PCT/US2011/063711 dated Sep. 26, 2012.
(Continued)

*Primary Examiner* — Patrick M Buechner

(57) ABSTRACT

A package (1000) for containing a fluidic product. In one embodiment of the invention, the package comprises a first laminate sheet (200) and a second laminate sheet (300) thermoformed together to form a unitary body (100). The unitary body (100) has a product containing portion (110)
(Continued)

having a product cavity containing a fluidic product, a nozzle portion (120) for dispensing the fluidic product from the product cavity, and a break-off cap (130) sealing a dispensing orifice of the nozzle portion (120). Each of the first and second laminate sheets (200, 300) includes a layer of polyethylene (PE) and a layer of polyethylene terephthalate (PET). The layer of PE has a first thickness and the layer of PET has a second thickness, the second thickness being less than or equal to the first thickness.

12 Claims, 11 Drawing Sheets

(51) Int. Cl.

| | |
|---|---|
| ***B65D 1/09*** | (2006.01) |
| ***B65D 35/08*** | (2006.01) |
| ***B65D 41/32*** | (2006.01) |
| ***B65D 47/10*** | (2006.01) |
| ***B65D 75/30*** | (2006.01) |
| ***B65D 75/32*** | (2006.01) |
| ***B65D 75/52*** | (2006.01) |
| ***B65D 85/72*** | (2006.01) |

(52) U.S. Cl.
CPC ..... *B65D 41/325* (2013.01); *B65D 47/10* (2013.01); *B65D 75/30* (2013.01); *B65D 75/322* (2013.01); *B65D 75/323* (2013.01); *B65D 75/527* (2013.01); *B65D 85/72* (2013.01)

(58) Field of Classification Search
CPC ..... B65D 75/324; B65D 75/5811; B65D 75/5816; B65D 41/325; B65D 85/72
See application file for complete search history.

(56) References Cited

U.S. PATENT DOCUMENTS 4,261,482 A * 4/1981 Yamada ..... B29C 49/22 222/107
4,526,823 A * 7/1985 Farrell ..... B32B 27/20 220/62.11
4,626,456 A * 12/1986 Farrell ..... B32B 27/20 222/107
4,747,501 A * 5/1988 Greaves ..... B65D 51/223 215/226
5,234,688 A * 8/1993 Gaffar ..... A61K 8/24 206/524.1
5,529,224 A * 6/1996 Chan ..... B65D 75/58 222/107
5,826,737 A 10/1998 Zakensberg
5,996,845 A * 12/1999 Chan ..... B65D 75/58 206/469
6,874,665 B2 4/2005 Doherty et al.
6,902,335 B2 6/2005 Bergey et al.
6,991,140 B2 * 1/2006 Bourque ..... B65D 47/148 215/48
7,036,690 B2 5/2006 Tsubaki et al.
7,431,529 B1 10/2008 Rushe et al.
2003/0075561 A1 4/2003 Pieri
2004/0214981 A1 10/2004 Denis et al.
2005/0011794 A1 1/2005 Caldwell et al.
2005/0287323 A1 12/2005 Akiyama et al.
2010/0054636 A1 * 3/2010 Owensby ..... B65D 33/004 383/38
2010/0155396 A1 6/2010 Warner
2011/0100861 A1 * 5/2011 Manabe ..... A61J 1/067 206/524.6
2012/0114269 A1 * 5/2012 Futase ..... B65D 31/14 383/104
2012/0237643 A1 * 9/2012 Wegner ..... B65D 75/42 426/115
2013/0098864 A1 * 4/2013 Fontana ..... A61J 1/067 215/250
2013/0272630 A1 * 10/2013 Thomas ..... B65D 75/5805 383/201
2014/0001065 A1 * 1/2014 Martinez Navarro .... B31B 1/26 206/222
2015/0000064 A1 1/2015 Moskovich et al.

OTHER PUBLICATIONS

The International Search Report and the Written Opinion of the International Searching Authority issued in International Application PCT/US2013/050076 dated Sep. 25, 2013.
The Written Opinion of the International Preliminary Examining Authority issued in International Application PCT/US2013/050076 dated Jul. 28, 2014.
The International Search Report and the Written Opinion of the International Searching Authority issued in International Application PCT/US2011/063717 dated Sep. 28, 2012.
The International Search Report and the Written Opinion of the International Searching Authority issued in International Application PCT/US2013/050069 dated Sep. 25, 2013.
The Written Opinion of the International Preliminary Examining Authority issued in International Application PCT/US2013/050069 dated Jul. 28, 2014.

* cited by examiner

PACKAGE HAVING UNITARY BODY INCLUDING A BREAK-OFF CAP

CROSS-REFERENCE TO RELATED PATENT APPLICATIONS

The present application is a U.S. national stage entry under 35 U.S.C. § 371 of Patent Cooperation Treaty Patent Application No. PCT/US2013/050076, filed Jul. 11, 2013, which claims priority to Indian National Patent Application No. 2161/DEL/2012, filed on Jul. 12, 2012, all of which are incorporated in their entireties by reference herein.

FIELD OF THE INVENTION

The present invention relates generally to low-cost packaging for fluidic products, such as oral care materials, and specifically to packages having a unitary body which includes a product containing portion, a nozzle portion, and a break-off cap.

BACKGROUND OF THE INVENTION

Oral care materials, such as toothpaste, are generally packaged in tubes or sachets. The advantage of a tube is that it is reclosable, offers prolonged shelf-life, protects the integrity of the toothpaste itself (e.g., acts as a barrier to flavors, water and other actives in toothpaste), provides a good surface for graphics, and is easy to dispense through the nozzle. Over the years, progress has been made to increase the efficiency of the tube making process and down gauge the materials. All these efforts have decreased the cost of tubes. However, even with these decreased costs, the price point achievable using tubes to package toothpaste is still too costly for low income consumers in emerging markets.

To achieve a price point acceptable to such consumers, it is believed that the cost of the tube package has to decrease stepwise, not incrementally. It is further believed that the modification of current tube or reclosable sachets will not be sufficient because the largest cost component of the current tube or reclosable sachets (with fitments) is the high cost due to the complicated processes involved in making these packages.

For example, the tube making process begins with the formation of a first laminate into a tube body. Separately, a shoulder and cap assembly is formed. Lastly, the tube body and shoulder and cap assembly are coupled together. The tube is then filled and sealed. The process is essentially the same for forming reclosable sachets. First, the fitment is made. Then the sachet is formed. The fitment and sachet are then assembled, filled and sealed.

Existing tube and sachet formation technology is believed to be prohibitive of suitable cost reduction for toothpaste (and other fluidic products) in emerging markets. A need exists for a new package format for toothpaste. To dramatically decrease the cost, the new format or the new process needs to be simplified.

BRIEF SUMMARY OF THE INVENTION

The present invention departs from accepted packaging technology for oral care materials, such as toothpaste, and utilizes a thermoforming process to create said packaging. In one embodiment, the package of the present invention utilizes thermoforming to form, fill and seal the package on one machine in no more than two steps, and possibly in a one-step process. The package of the present invention, in such an embodiment, is reclosable.

In one embodiment, the invention can be a package comprising: a first laminate sheet and a second laminate sheet coupled together to form a unitary body comprising a product containing portion having a product cavity containing an oral care fluidic product; each of the first and second laminate sheets comprising a layer of polyethylene (PE) and a layer of polyethylene terephthalate (PET), wherein the layer of PE has a first thickness and the layer of PET has a second thickness, the second thickness being less than or equal to the first thickness.

In another embodiment, the invention can be a package comprising: a unitary body comprising: a product containing portion having a product cavity containing a fluidic product; a nozzle portion for dispensing the fluidic product from the product cavity; a break-off cap sealing a dispensing orifice of the nozzle portion, the break-off cap comprising a nozzle cavity having an insertion opening for slidably receiving the nozzle portion; and a cover that seals the insertion opening of the nozzle cavity; a first pre-weakened area in the unitary body that defines a top edge of the nozzle portion and a bottom edge of the break-off cap, the dispensing orifice of the nozzle portion being exposed upon separating the break-off cap from the nozzle portion along the first pre-weakened area; and a second pre-weakened area in the unitary body that defines a bottom edge of the cover and a top edge of the break-off cap, the insertion opening of the break-off cap being exposed upon separating the cover from the nozzle portion along the second pre-weakened area.

In yet another embodiment, the invention can be a package comprising: a unitary body comprising a product containing portion having a product cavity containing a fluidic product, a nozzle portion for dispensing the fluidic product from the product cavity, and a break-off cap sealing a dispensing orifice of the nozzle portion, the break-off cap comprising a nozzle cavity having an insertion opening for slidably receiving the nozzle portion; a removable cover that seals the insertion opening of the nozzle cavity; and a first pre-weakened area in the unitary body that defines a top edge of the nozzle portion and a bottom edge of the break-off cap, the dispensing orifice of the nozzle portion being exposed upon separating the break-off cap from the nozzle portion along the first pre-weakened area.

In still another embodiment, the invention can be a package comprising: a unitary body comprising: a product containing portion having a product cavity containing a fluidic product; a nozzle portion for dispensing the fluidic product from the product cavity; a first break-off cap sealing a dispensing orifice of the nozzle portion; a second break-off cap comprising a nozzle cavity having an insertion opening for slidably receiving the nozzle portion; a first pre-weakened area in the unitary body that defines a top edge of the nozzle portion and a bottom edge of the first break-off cap, the dispensing orifice of the nozzle portion being exposed upon separating the first break-off cap from the nozzle portion along the first pre-weakened area; and a second pre-weakened area in the unitary body that defines a bottom edge of the product containing portion and a top edge of the second break-off cap, the insertion opening of the second break-off cap being exposed upon separating the second break-off cap from the product containing portion along the second pre-weakened area.

In another embodiment, the invention can be a package comprising: a first laminate sheet and a second laminate sheet coupled together to form a unitary body comprising: a product containing portion having a product cavity containing a fluidic product; a nozzle portion for dispensing the fluidic product from the product cavity; and a break-off cap sealing a dispensing orifice of the nozzle portion, the break-off cap comprising a nozzle cavity having an insertion opening for slidably receiving the nozzle portion; and a first pre-weakened area in the unitary body that defines a top edge of the nozzle portion and a bottom edge of the break-off cap, the dispensing orifice of the nozzle portion being exposed upon separating the break-off cap from the nozzle portion along the first pre-weakened area; at least one indent located on either the nozzle portion or the break-off cap; at least one protrusion located on the other one of the nozzle portion or the break-off cap; and wherein when the nozzle portion is slidably inserted into the nozzle cavity of the break-off cap, the at least one indent and the at least one protrusion mate with one another.

In a still further embodiment, the invention can be a toothpaste multipack comprising: a plurality of packages interconnected to form a longitudinal strip, each package comprising a first laminate sheet and a second laminate sheet coupled together to form a unitary body comprising a product containing portion having a product cavity containing toothpaste, a nozzle portion for dispensing the toothpaste from the product cavity, and a break-off cap sealing a dispensing orifice of the nozzle portion; and wherein adjacent packages in the longitudinal strip are separated from one another by a transverse pre-weakened area.

The present invention solves the needs described above by enabling a recloseable package to be formed by a thermoforming process in one step and by a single machine. The present invention solves the above while providing protection for the product on the shelf and during use, enabling recloseability to satisfy consumer need and resulting in an easy dispensing package.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE INVENTION

Figure 1:
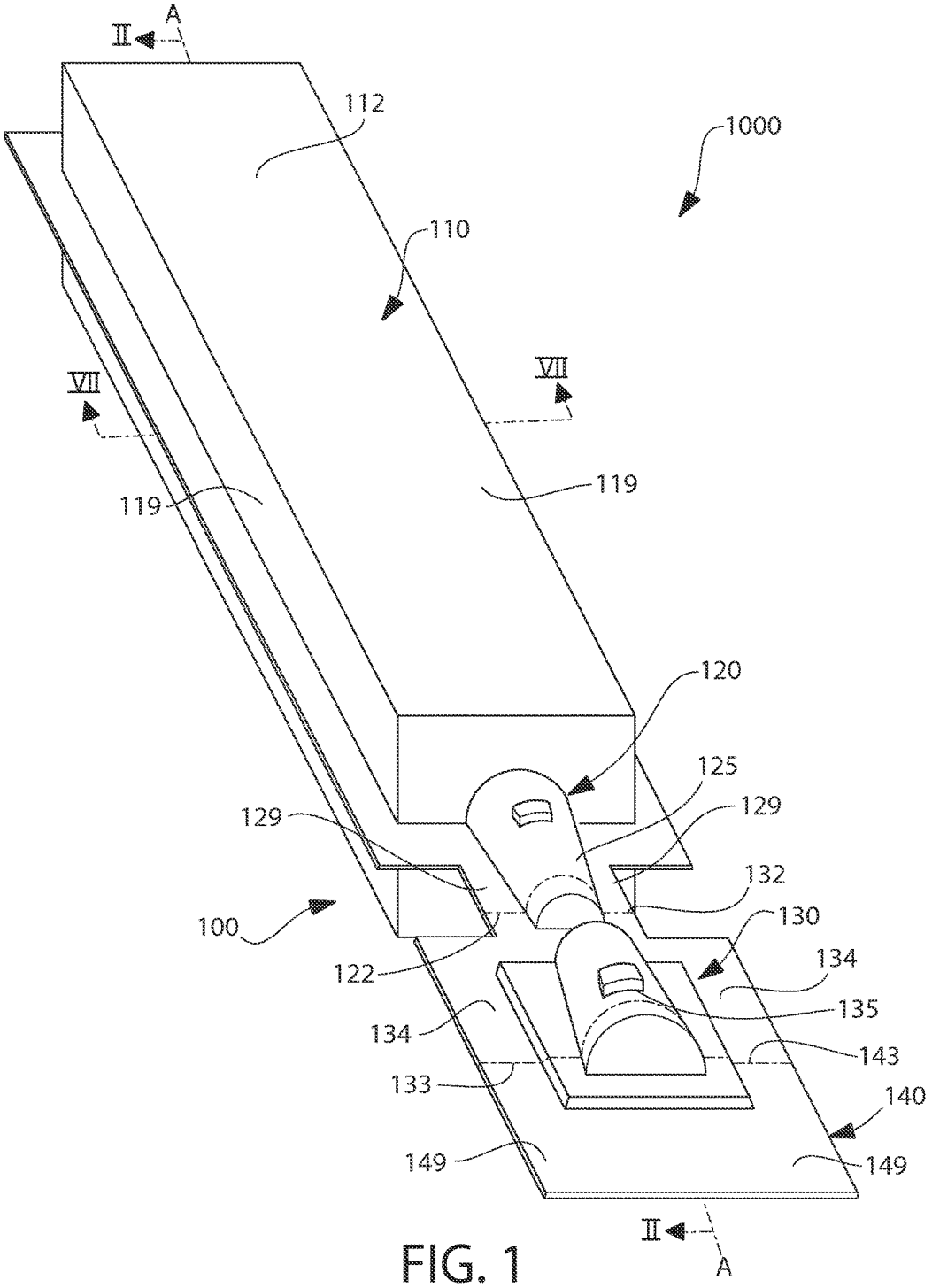
FIG. 1 is a perspective view of a package according to an embodiment of the present invention.

The following description of the preferred embodiment(s) is merely exemplary in nature and is in no way intended to limit the invention, its application, or uses.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

Figure 2:
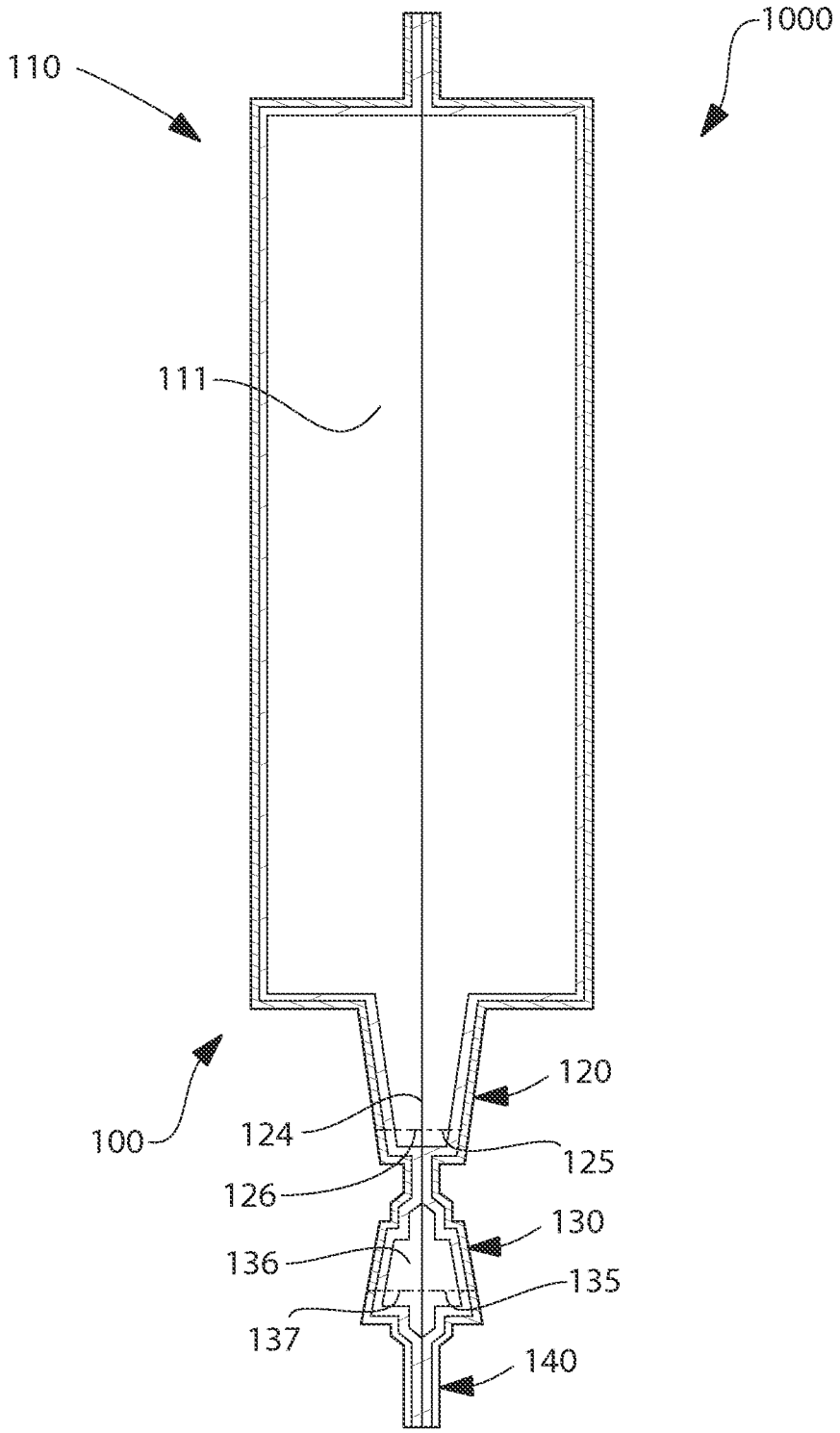
FIG. 2 is a longitudinal cross-sectional view of the package of FIG. 1 taken along view II-II of FIG. 1.

Referring first to FIG. 1, a package 1000 in accordance with an embodiment of the present invention will be generally described. The package 1000 includes a unitary body 100 comprising a product containing portion 110, a nozzle portion 120, a break-off cap 130 and a cover 140. The unitary body 100 of the package 1000 extends along a longitudinal axis A-A. It will be understood from the description below that the cover 140 can be considered a break-off cover. The product containing portion 110 has a product cavity 111 (referring to FIG. 2) for containing a fluidic product therein.

In certain embodiments, the fluidic product is an oral care material, such as a dentifrice, toothpaste, mouthwash, whitening agent or the like. Of course, the invention is not so limited and in certain other embodiments the fluidic product can be any other type of fluidic product desired to be packaged as described. In certain embodiments, the product containing portion 110 contains between approximately 0.1 mL to 50.0 mL of the oral care material or other fluidic product. However, the invention is not to be so limited and the product containing portion 110 can contain more or less of the oral care material or other fluidic product as desired.

For example, the package 1000 can be a single use package containing only an amount of the fluidic product required for a single use thereof.

Figure 7:
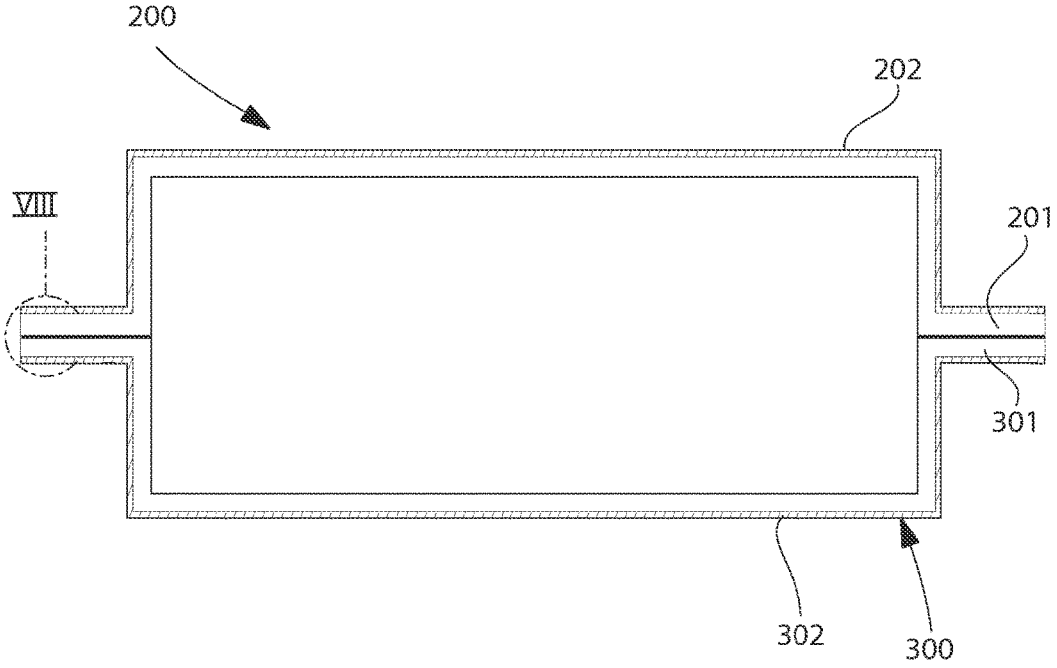
FIG. 7 is a transverse cross-sectional view of the package of FIG. 1 taken along view VII-VII of FIG. 1.
Figure 8:
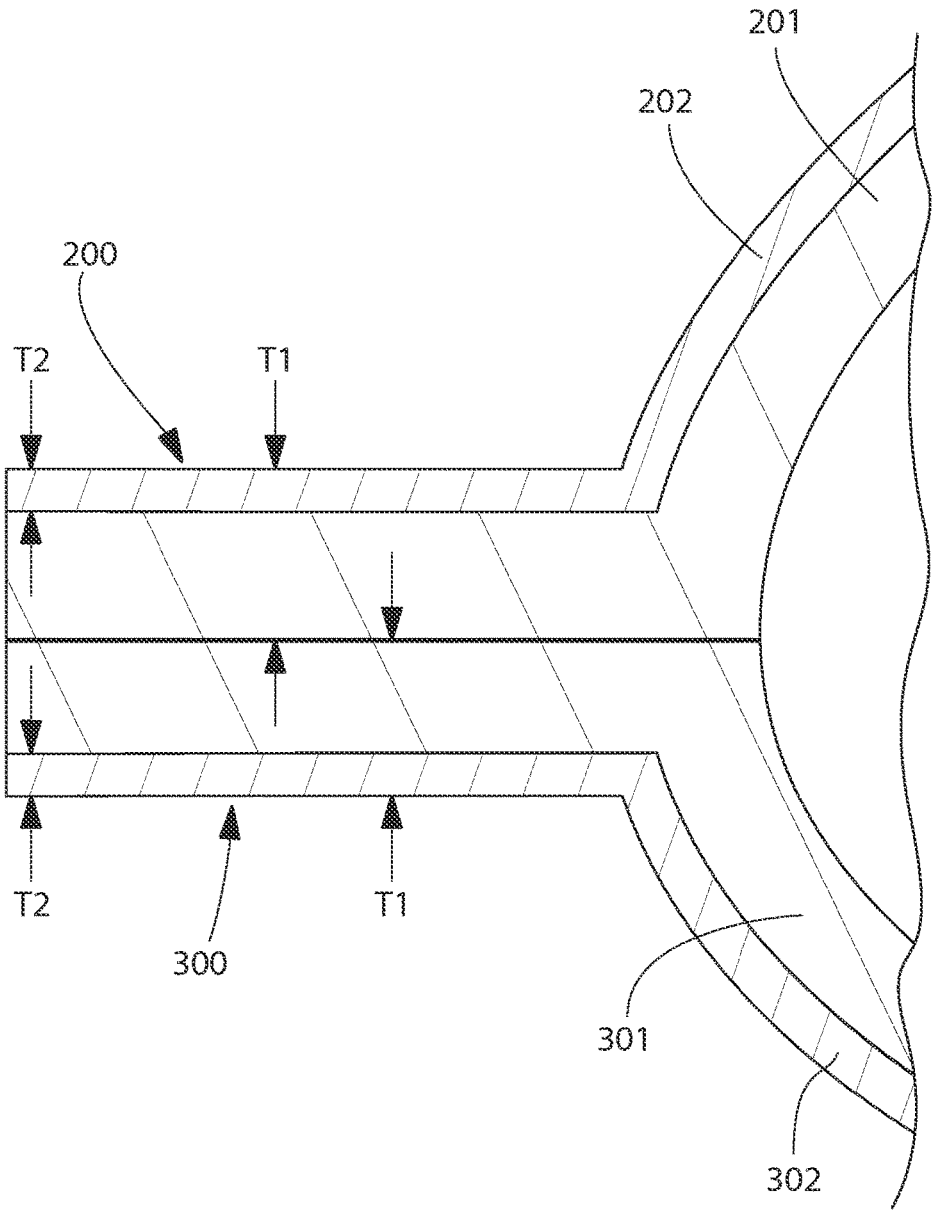
FIG. 8 is a close-up view of area VIII of FIG. 7.

Referring to FIGS. 1, 7 and 8 concurrently, the package 1000 is formed of a first laminate sheet 200 and a second laminate sheet 300 that are thermoformed together in a single machining process to form the unitary body 100. As used herein, the term laminate sheet includes a single sheet, a multi-layer laminate, or a single sheet that is folded over to form a multi-layer sheet. In the exemplified embodiment, each of the first and second laminate sheets 200, 300 are two-layer laminates. However, it is contemplated that the laminate sheets 200, 300 can be a single-layer sheet, and may include three or more layers in other embodiments as will be described below. Specifically, in the embodiment exemplified in FIGS. 1, 7 and 8, each of the first and second laminate sheets 200, 300 comprise a layer of polyethylene (PE) 201, 301 and a layer of polyethylene terephthalate (PET) 202, 302. The layer of PE 201, 301 of both the first and second laminate sheets 200, 300 has a first thickness T1 and the layer of PET 202, 302 of both the first and second laminate sheets 200, 300 has a second thickness T2. The second thickness T2 is less than or equal to the first thickness T1. In other words, the first thickness T1 of the PE layers 201, 301 of the first and second laminate sheets 200, 300 is greater than or equal to the second thickness T2 of the PET layers 202, 302 of the first and second laminate sheets 200, 300.

In certain embodiments, the first thickness T1 is in a range of 15 to 500 microns and the second thickness T2 is in a range of 50 to 300 microns. In other embodiments, the first thickness T1 is about 50 microns and the second thickness T2 is in a range of 10 to 200 microns for each of the first and second laminate sheets 200, 300. However, the invention is not to be so limited and other thicknesses can be used as long as the first thickness T1 is greater than or equal to the second thickness T2. In certain other embodiments, a ratio of the first thickness T1 to the second thickness T2 is in a range of 2:1 to 4:1. In still other embodiments, the ratio of the first thickness T1 to the second thickness T2 is about 3:1.

The PET layers 202, 302 provide stiffness to the unitary body 100. By positioning the PET layers 202, 302 as the outer layers of the first and second laminate sheets 200, 300 and the PE as the inner layers of the first and second laminate sheets 200, 300, the PET layers 202, 302 protect the structural integrity and rigidness of the unitary body 100 of the package 1000. Furthermore, PET is a more expensive material than PE. Thus, overall manufacturing costs can be significantly reduced by using the PET as an outer layer that has a smaller thickness than the inner PE layers.

In the exemplified embodiment, the PE layer 201, 301 is bonded directly to the PET layer 202, 302 for each of the first and second laminate sheets 200, 300 by a thermoforming process. Thus, the PE layer 201 is bonded to the PET layer 202 and the PE layer 301 is bonded to the PET layer 302 by heating the layers 201, 301, 202, 302 and then thermally welding them together. As is known to persons skilled in the art, PE and PET have different melting temperatures. Specifically, PE has a melting point in a range of about 105° C. to 130° C. and PET has a melting point of PET is in a range of about 240° C. to about 270° C. The higher melting point of PET enables the PE layer 201 of the first laminate sheet 200 to be heat bonded to the PE layer 301 of the second laminate sheet 300 without melting and potentially disfiguring the PET layers 202, 302 of the first and second laminate sheets 200, 300. Thus, the inner PE layer 201 of the first laminate sheet 200 is thermally fused to the inner PE layer 301 of the second laminate sheet 300.

In other embodiments not illustrated, each of the first and second laminate sheets 200, 300 can include a tie layer that is disposed between and couples the PE layer 201, 301 to the PET layer 202, 302 for each of the first and second laminate sheets 200, 300. The tie layer is formed of a material selected from the group consisting of ethylene acrylic acid, anhydride modified ethylene acrylate adhesive resin, a copolymer of ethylene and methacrylic acid, ethylene ethyl acrylate copolymer, modified polyethylene, modified polyolefin, ionomers, and methacrylic acid modified polyethylene.

In embodiments that include a tie layer, the tie layer has a third thickness that is in a range of about 5 to 30 microns. Furthermore, in still other embodiments, the PE layer 201, 301 and the PET layer 202, 302 of each of the first and second laminate sheets 200, 300 are coupled together via an adhesive or other bonding agent to enhance the bonding strength of the layers 201, 202 and 301, 302 to one another. In one embodiment, the adhesive layer may be polyurethane. Thus, from the outer surface to the inner surface, the layers can be PET/PE, PET/adhesive/PE or PET/tie layer/PE. While the foregoing describes embodiments where the laminate sheets 200, 300 are formed of PE and PET layers, in some embodiments, the laminate sheets 200, 300 are formed of PE and polyamide (PA) layers.

Table 1 below illustrates the moisture vapor transmission rate (MVTR) i.e., in grams per meter square per day, for typical films used in constructing a comparable package, a comparable package constructed using typical plastic barrier laminate, and for a package 1000 that may be constructed using the laminate sheets 200, 300.

TABLE 1

| Material for Construction | MVTR |
|---|---|
| LDPE | 15-23 |
| HDPE | 4.65-6.2 |
| PET | 15-19.5 |
| Typical plastic barrier laminate | ≤0.5 |
| Laminate according to present invention | 0.24 |

Table 1 illustrates that a package 1000 that may be constructed using the laminate sheets 200, 300 has a lower moisture vapor transmission rate as compared to that of a package 1000 constructed using a typical plastic barrier laminate. In addition, a package 1000 that may be constructed using the laminate sheets 200, 300 has a much lower moisture vapor transmission rate as compared to that of a package 1000 constructed using other films that are typically found in the construction of comparable packages. A lower moisture vapor transmission rate suggests that the product contained within the package 1000 may be preserved longer as no moisture is leaving or entering the package 1000.

Referring now to FIGS. 1-4 concurrently, the structural components of the package 1000 will be described in more detail. As described above, the package 1000 generally comprises the product containing portion 110, the nozzle portion 120, the break-off cap 130 and the cover 140. In the exemplified embodiment, the product cavity 111 is a cone-shaped cavity having a smaller volume capacity near a bottom end 112 of the unitary body 100 and a larger volume capacity near the nozzle portion 120 of the unitary body 100. However, the invention is not to be limited by the particular shape of the product cavity 111 and any other shape may be used.

The product containing portion 110 has a sealing flange 119, the nozzle portion 120 has a sealing flange 129, the break-off cap 130 has a sealing flange 134 and the cover 140 has a sealing flange 149. The sealing flanges 119, 129, 134 of the product containing portion 110, the nozzle portion 120 and the break-off cap 130 collectively seal the product cavity 111 around its periphery to prevent any fluidic products within the product cavity 111 from leaking out along the periphery of the product cavity 111. The sealing flanges 119, 129, 134 of the product containing portion 110, the nozzle portion 120 and the break-off cap 130 also prevents contaminants from entering the product cavity 111 around its periphery. The sealing flanges 129, 134 of the nozzle portion 120 and the break-off cap combine to seal a dispensing conduit 124 of the nozzle portion 120 to prevent any fluidic products within the product cavity 111 from leaking out through the dispensing conduit 124. Furthermore, the sealed flanges 134, 149 of the break-off cap 130 and the cover 140 collectively seal a nozzle cavity 136 of the break-off cap 130 to protect the nozzle cavity 136 against contamination from dust and other debris.

It should be understood that in certain embodiments the term "seal" is intended to mean a hermetic seal whereby fluids can not penetrate the seal. This usage of the term seal is particularly desirable in terms of the seal of the nozzle portion 120 and the product cavity 111 described above where it is desired to prevent leakage of fluidic products from the product cavity 111 and dispensing conduit 124. However, in other instances the term seal is used in this application to refer to substantially closing an opening, while not necessarily meaning hermetically sealing that opening. Specifically, as described above the sealed flanges 134, 149 of the break-off cap 130 and the cover 140 seal the nozzle cavity 136 of the break-off cap 130 to prevent the intrusion of dusts and other debris into the nozzle cavity 136. However, the nozzle cavity 136 does not need to be hermetically sealed, just substantially closed.

The package 1000 includes a first pre-weakened area 125 formed in the unitary body 100 that defines a top edge 122 of the nozzle portion 120 and a bottom edge 132 of the break-off cap 130. The package 1000 also includes a second pre-weakened area 135 formed in the unitary body 100 that defines a top edge 133 of the break-off cap 130 and a bottom edge 143 of the cover 140.

In certain embodiments, the first and second pre-weakened areas 125, 135 are perforations or scored lines formed into the unitary body 100. In other embodiments, the pre-weakened areas 125, 135 can be the result of pre-creasing the unitary body 100 at desired locations. In still other embodiments, the pre-weakened areas 125, 135 can be an area of reduced wall thickness on the unitary body 100. Combinations of the above-mentioned types of pre-weakened areas or other methods of compromising the integrity of the unitary body 100 at the location of the pre-weakened areas 125, 135 in a controlled manner through the use of chemical energy, thermal energy, mechanical energy, or combinations thereof can be used. However, it is desirable that the first and second pre-weakened areas 125, 135, and most particularly the first pre-weakened area 125, do not result in the creation of an opening in the unitary body 100 through which fluidic products contained within the product cavity 111 can flow and leak. Thus, regardless of how the pre-weakened areas 125, 135 are formed, they should create a seal as that term has been defined herein above.

The second pre-weakened area 135 enables a user to easily tear the unitary body 100 at the location of the second pre-weakened area 135 to separate the cover 140 from the break-off cap 130. Similarly, the first pre-weakened area 125 enables a user to easily tear the unitary body 100 at the location of the first pre-weakened area 125 to separate the break-off cap 130 from the nozzle portion 120. In certain other embodiments, the first and second pre-weakened areas 125, 135 can be an indicia line including the words "open here" to indicate to a consumer that the unitary body 100 should be tear open at those locations.

The nozzle portion 120 is designed for dispensing the fluidic product from the product cavity 111. Specifically, the nozzle portion 120 includes a dispensing conduit 124 that extends from the product cavity 111 to a location beyond the first pre-weakened area 125. In other words, the first pre-weakened area 125 intersects the dispensing conduit 124 of the nozzle portion 120. The nozzle portion 120 also includes a dispensing orifice 126, which is the opening through which the fluidic product is dispensed to a consumer during use. Prior to opening of the package 1000, the dispensing orifice 126 is sealed by the break-off cap 130 at the first pre-weakened area 125. In other words, the break-off cap 130 is affixed to the nozzle portion 120 at the location of the first pre-weakened area 125 in such a manner that the dispensing orifice 126 becomes sealed to prevent leakage of the fluidic product from the product cavity 111 prior to desired use by the consumer. By extending the dispensing conduit 124 beyond the location of the first pre-weakened area 125, when the break-off cap 130 is detached from the nozzle portion 120 as has been described above, the dispensing orifice 126 becomes open and exposed thereby enabling the fluidic product to flow from the product cavity 111 through the dispensing conduit 124 and out of the dispensing orifice 126 for application onto a toothbrush or for other desired use.

The break-off cap 130 comprises the sealing flange 134, the nozzle cavity 136, and a connector 165. The connector 165 is a portion of the break-off cap 130 that is connected to the dispensing orifice 126 of the nozzle portion 120 at the first pre-weakened area 125. The nozzle cavity 136 comprises an insertion opening 137, which includes a passageway to receive the nozzle portion 120. When the break-off cap 130 is used to reseal the package 1000 after opening, the nozzle portion 120 is inserted into the insertion opening 137 of the nozzle cavity 136.

The nozzle cavity 136 is defined by an inner surface 155 of a portion of the break-off cap 130. The nozzle cavity 136 tapers inwardly as it extends from the second pre-weakened area 135 towards the location of the first pre-weakened area 125. This tapering facilitates coupling of the break-off cap 130 to the nozzle portion 120 as described in detail below. The insertion opening 137 is sized so as to fit the nozzle portion 120 therethrough. Specifically, the diameter of the insertion opening 137 is slightly larger than the diameter of the top edge 126 of the nozzle portion 120 so that the top edge 122 of the nozzle portion 120 can be slidably received by the insertion opening 137. Thus, as will be described below, the break-off cap 130 can be used to reseal the dispensing orifice 126 of the nozzle portion 120. Prior to opening the package 1000, the nozzle cavity 136 and insertion opening 137 of the break-off cap 130 are sealed by the cover 140 at the second pre-weakened area 135 such that the nozzle cavity 136 is unexposed until the cover 140 is torn from the unitary body 100 along the second pre-weakened area 135 as described above. In other words, the cover 140 seals the nozzle cavity 136 at the insertion opening 137 (not necessarily hermetically) so as to prevent dust, debris and other contaminants from entering into the nozzle cavity 136 through the insertion opening 137. In some embodiments, the insertion opening 137 has a width that is between the width of the top edge 133 of the break-off cap 130, and the width of the width orifice 126. In some embodiments, the insertion opening 137 has a width between 18.0 mm to 18.5 mm.

Referring to FIGS. 1 and 3-5, the functionality of the recloseable feature of the package 1000 will be described. The consumer will purchase the package 1000 including the product containing portion 110, the nozzle portion 120, the break-off cap 130 and the cover 140 all coupled together as the unitary body 100. When the user desires to gain access to the fluidic product contained within the product cavity 111, the user will first separate the cover 140 from the break-off cap 130 by tearing the unitary body 100 at the second pre-weakened area 135. Once the cover 140 is removed from the break-off cap 130, the insertion opening 137 and the nozzle cavity 136 are exposed.

It should be understood that the cover 140 is affixed to the break-off cap 130 to thereby seal the insertion opening 137 and the nozzle cavity 136. However, as has been described above, the seal between the cover 140 and the break-off cap 130 is not necessarily a hermetic seal (although it can be in certain embodiments). The cover 140 acts as a dust cover to prevent dust and other contaminants from entering into the nozzle cavity 136 so that when the break-off cap 130 is resealed onto the nozzle portion 120 as will be discussed below, the nozzle portion 120 does not becomes contaminated. Furthermore, in certain embodiments the cover 140 can be a removable cover that does not form a portion of the unitary body 100. For example, the cover can be a plug, a removable or pull-off tab or a cap that receives or encloses a portion of the break-off cap 130. In one embodiment, the cover 140 may be a plug that snugly fits within the nozzle cavity 136 of the break-off cap 130 to prevent contaminants from entering into the nozzle cavity 136. In another embodiment, the cover 140 may be a substantially flat sheet that covers the top edge 133 of the break-off cap 130.

Figure 3:
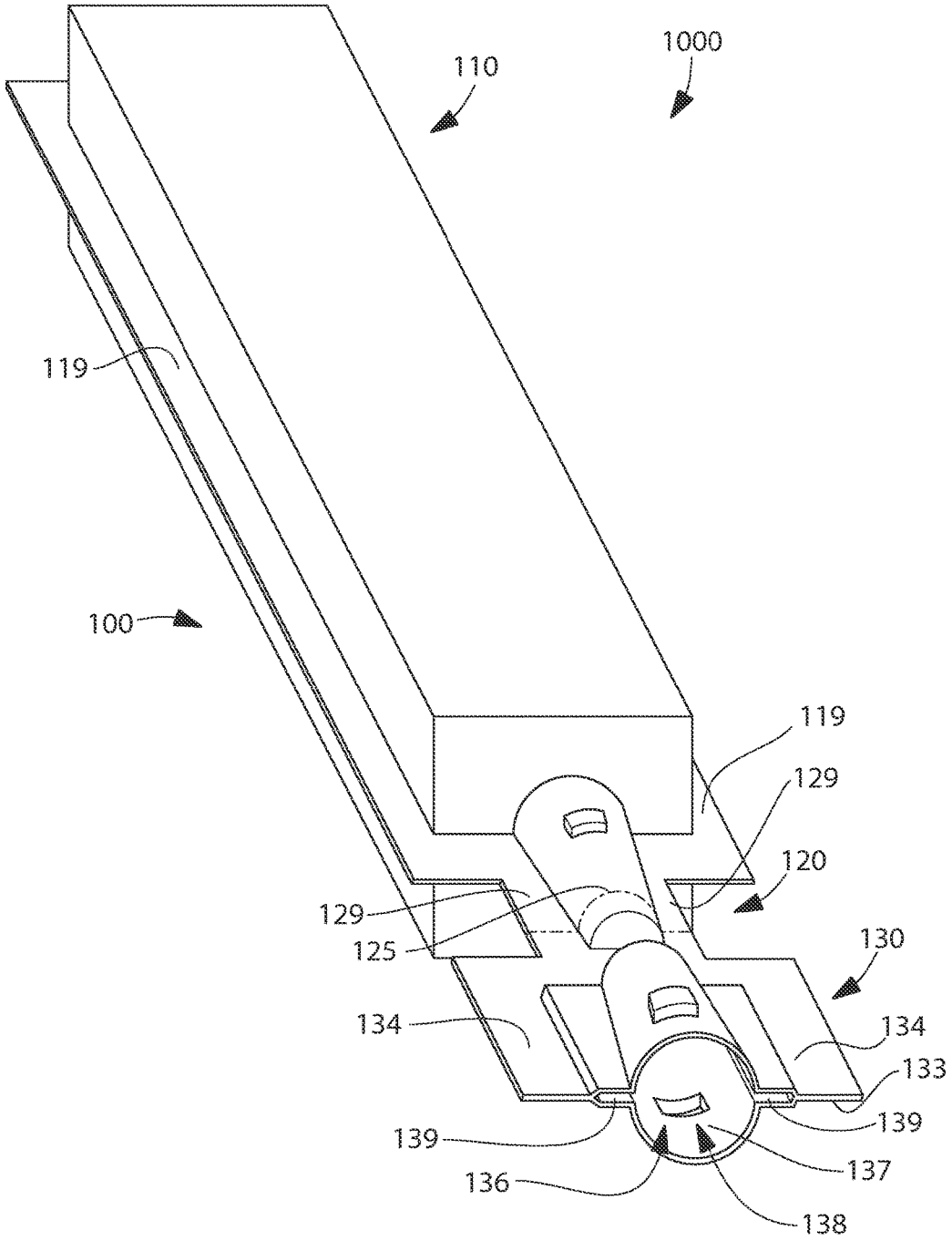
FIG. 3 is a perspective view of the package of FIG. 1 wherein the cover has been separated from the break-off cap along a second pre-weakened area.

Referring to FIG. 3, once the cover 140 is separated from the unitary body 100 by tearing along the second pre-weakened area 135, the insertion opening 137 and nozzle cavity 136 are exposed. The nozzle cavity 136 comprises a central bore 138 and a pair of slots 139 extending radially from the central bore 138. In the exemplified embodiment, the pair of slots 139 extend from opposing sides of the central bore 138 such that each of the slots 139 is separated from the other by 180°.

Figure 4:
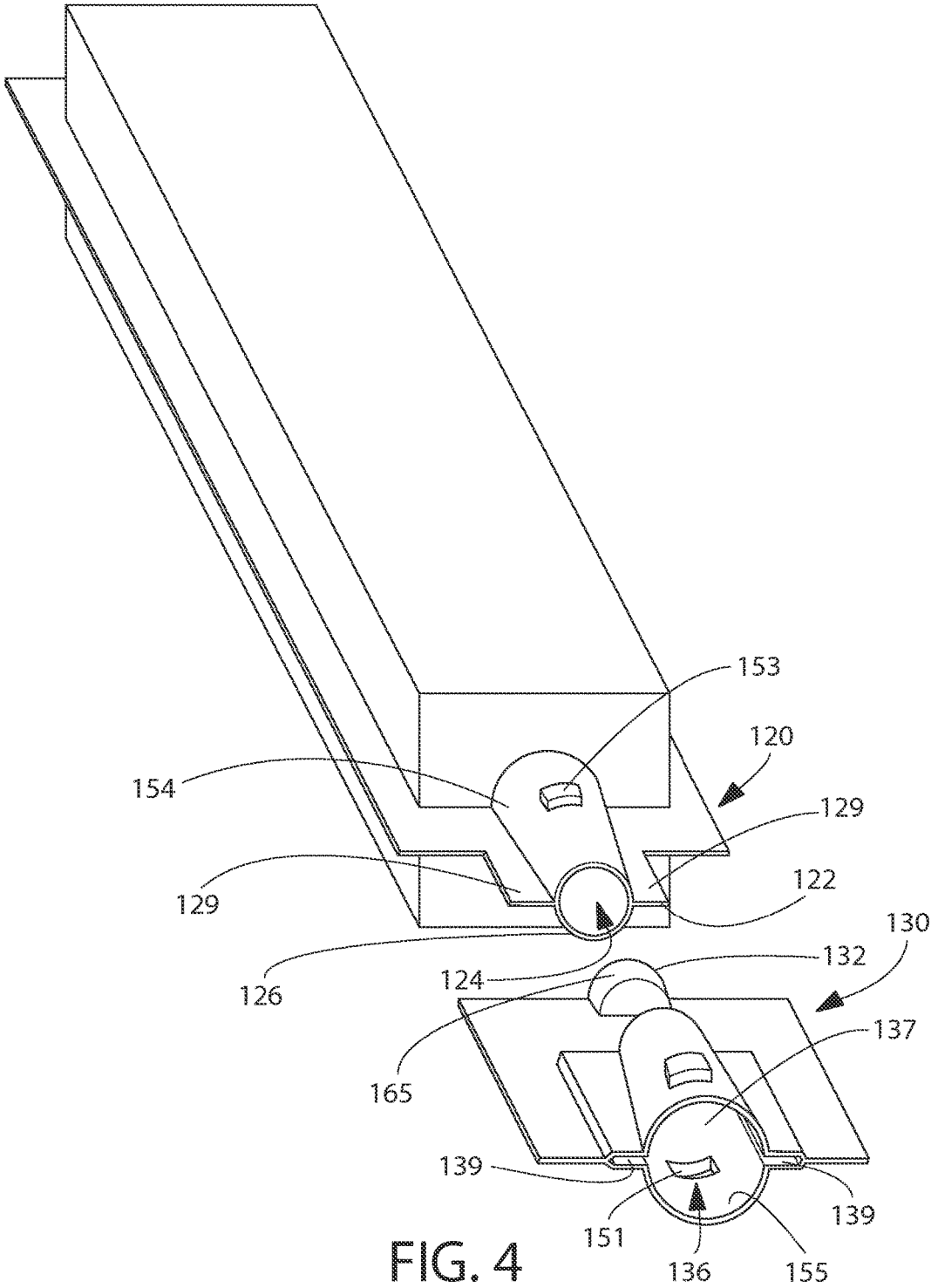
FIG. 4 is a perspective view of the package of FIG. 3 wherein the break-off cap has been separated from the nozzle portion along a first pre-weakened area to expose a dispensing orifice.

Referring to FIGS. 3 and 4 concurrently, the nozzle portion 120 comprises sealing flanges 129. The sealing flanges 129 are sized and configured to be slidably received within the slots 139 of the nozzle cavity 136. In other words, the sealing flanges 129 are sized and configured to fit snugly within the slots 139 of the nozzle cavity 136. For example, in some embodiments, the slots 139 generally have a width which is at least twice the thickness of the material that forms the package 1000 with a compression between 0% and 25%. The width of the slots 139 increases towards the nozzle cavity 136, i.e., the slots 139 are widest at the point where the slots 139 transitions into the nozzle cavity 136. For example, the slots 139 may generally have a width that is between approximately 1.4 mm to 2.7 mm, the slots 139 may have a width that is 1.45 mm to 3.23 mm at the point of where the slots 139 transition into the nozzle cavity 136. In some embodiments, the nozzle cavity 136 may have a depth that is between approximately 4.6 mm to 7.88 mm.

After separation of the cover 140 from the break-off cap 130, the break-off cap 130 can be separated from the nozzle portion 120 by tearing the unitary body 100 at the first pre-weakened area 125 or cutting the unitary body 100 at the location of the first pre-weakened area 125 if necessary or desirable. At this point, the break-off cap 130 is separated from the unitary body 100 such that the unitary body 100 comprises only the product containing portion 110 and the nozzle portion 120 (see FIG. 4).

The break-off cap 130 comprises at least one indent or protrusion 151 located thereon. In the exemplified embodiment, the break-off cap 130 comprises two indents or protrusions 151 positioned 180° apart along the inner surface 155 of the portion of the break-off cap 130 that defines the nozzle cavity 136. Of course, the invention is not so limited and in certain other embodiments the break-off cap 130 may comprise only a single indent or protrusion 151 or more than two indents or protrusions. Furthermore, in still other embodiments the two indents or protrusions 151 illustrated in the exemplary embodiments can be separated by less than 180°.

The nozzle portion 120 also comprises at least one indent or protrusion 153 on an outer surface 154 of the nozzle portion 120. In the exemplified embodiment, the nozzle portion 120 comprises two indents or protrusions 153 positioned 180° apart along the outer surface 154 of the nozzle portion 120. Similar to the indents or protrusions 151 of the break-off cap 130, there may be a single indent or protrusion 153 on the outer surface 154 of the nozzle portion 120 or more than two indents or protrusions 153. Furthermore, the spacing between the indents or protrusions 153 on the outer surface 154 of the nozzle portion 120 may be other than the 180° illustrated. If the break-off cap 130 comprises at least one indent 151 on its inner surface 155, then the nozzle portion 120 will comprise at least one protrusion 153 on its outer surface 154. Alternatively, if the break-off cap 130 comprises at least one protrusion 151 on its inner surface 155, then the nozzle portion 120 will comprise at least one indent 153 on its outer surface 154. It should be understood that the number of indents or protrusions 151 on the break-off cap 130 will correspond with the number of indents or protrusions 153 on the outer surface 154 of the nozzle portion 120 for mating engagement therebetween as described below.

As will be described below, the indents/protrusions 151, 153 of the nozzle portion 120 and the break-off cap 130 interlock together to prevent axial separation between the nozzle portion 120 and the break-off cap 130 after the break-off cap 130 is used to reseal the nozzle portion 120. In certain other embodiments, the indent/protrusion 151 of the break-off cap 130 can be replaced by an aperture such that a protrusion 153 on the outer surface 154 of the nozzle portion 120 can fit within and extend through the aperture to securely hold the break-off cap 130 on the nozzle portion 120 and prevent axial separation therebetween. In some embodiments, the indents/protrusions 151, 153 may be omitted. In these embodiments, the engagement between the nozzle portion 120 and the break-off cap 130 may be achieved via friction. For example, the inner surface 155 of the break-off cap 130 and the outer surface 154 of the nozzle portion 120 may be sized such that the nozzle portion 120 fits snuggly within the insertion opening 137 and the slots 139 when the break-off cap 130 is used to reseal the nozzle portion 120. While only one protrusion 153 is illustrated, in some embodiments, a plurality of protrusions 153 may be present on the nozzle portion 120.

Figure 5:
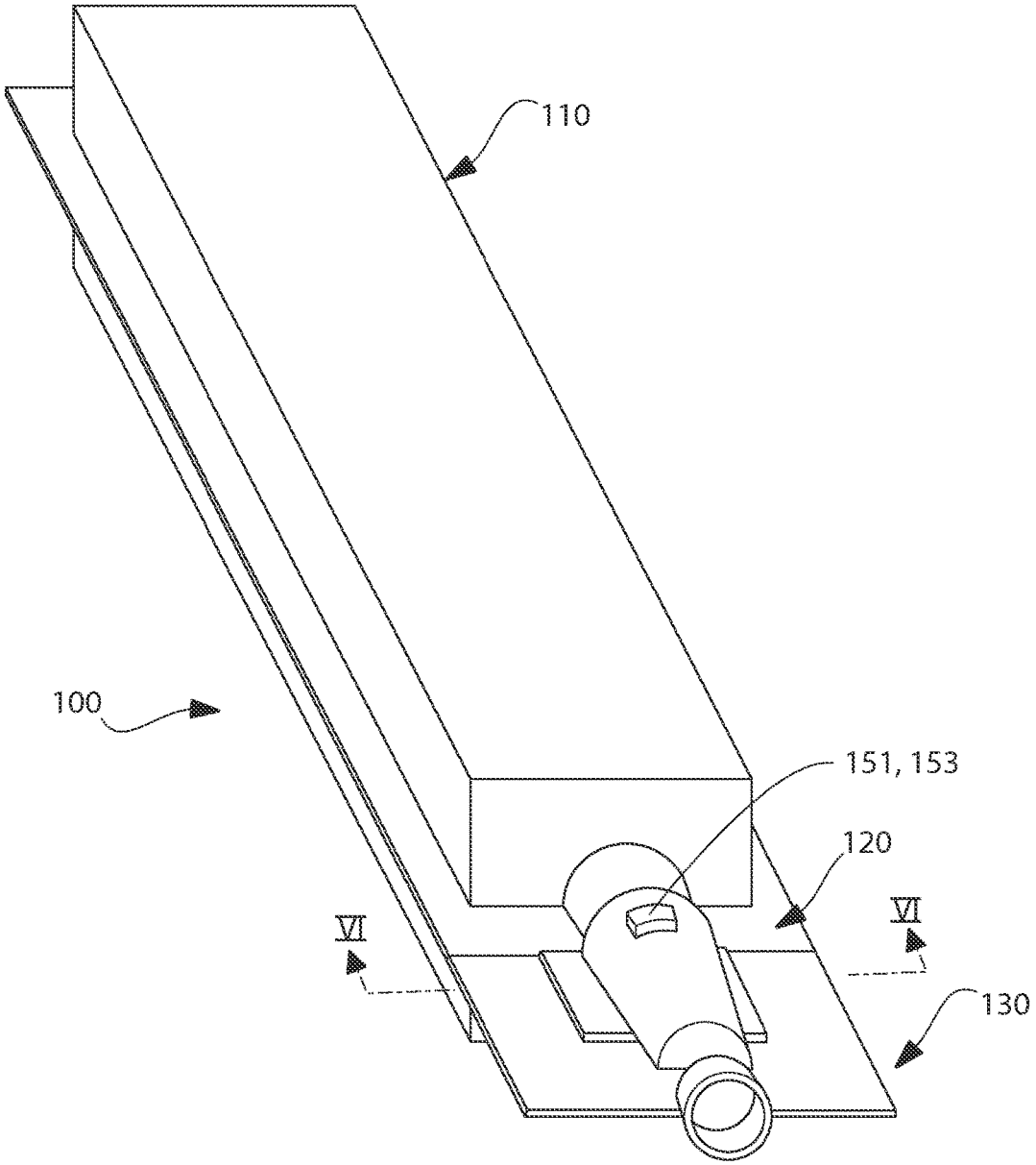
FIG. 5 is a perspective view of the package of FIG. 4 wherein the break-off cap has been inverted and placed over the nozzle portion to reseal the dispensing orifice according to an embodiment of the present invention.
Figure 6:
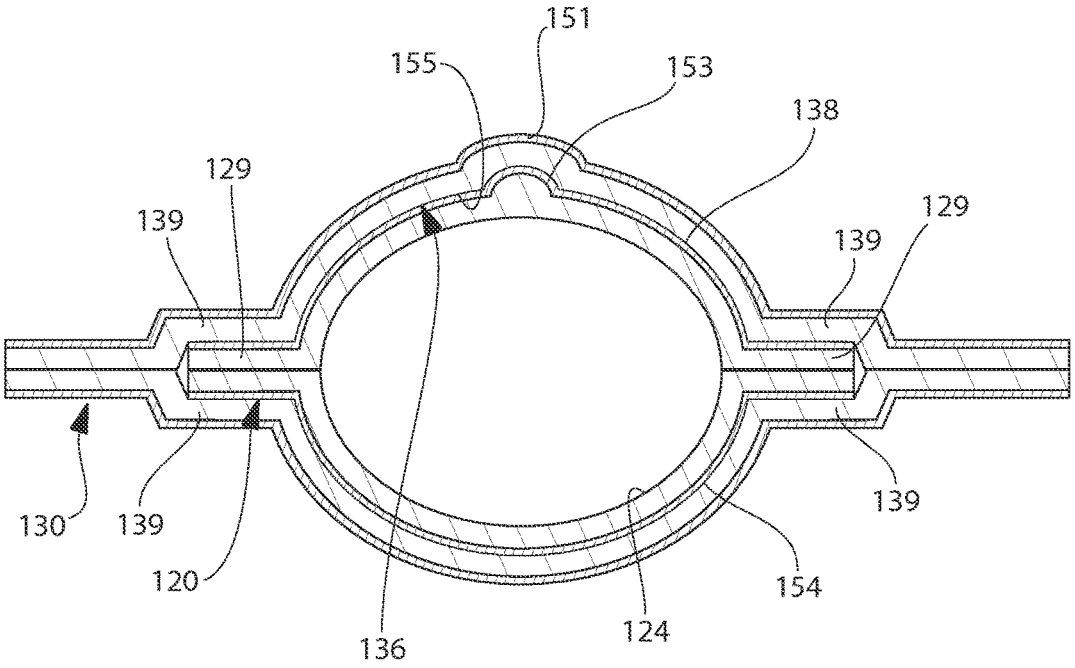
FIG. 6 is a transverse cross-sectional view of the package of FIG. 5 taken along view VI-VI of FIG. 5.

Referring to FIGS. 5 and 6, attachment of the break-off cap 130 to the nozzle portion 120 to reseal the nozzle portion 120 of the unitary body 100 will be described. After separating the break-off cap 130 from the nozzle portion 120 by tearing along the first pre-weakened area 125, the break-off cap 130 is rotated 180° about an axis transverse to the longitudinal axis A-A so that the nozzle cavity 136 of the break-off cap 130 is axially aligned with the dispensing orifice 126 of the nozzle portion 120. Furthermore, the slots 139 are axially aligned with the sealing flanges 129 of the nozzle portion 120 and the indents/protrusions 151 of the break-off cover 130 are axially aligned with the indents/protrusions 153 of the nozzle portion 120. In the exemplified embodiment of FIG. 6, the nozzle portion 120 comprises the protrusion 153 on its outer surface 154 that fits within the indent 151 on the inner surface 155 of the break-off cap 130. Of course, as discussed above, the invention is not to be so limited and in other embodiments the break-off cap 130 may comprise a protrusion that fits within an indent or an aperture on the nozzle portion 120.

The break-off cap 130 can be slid onto the nozzle portion 120 such that the nozzle portion 120 is slidably inserted into the nozzle cavity 136. More specifically, the inner surface 155 of the portion of the break-off cap 130 becomes slidingly engaged with the outer surface 154 of the nozzle portion 120. As noted above, the tapered shape of the nozzle cavity 136 of the break-off cap 130 facilitates this slidable insertion. As a result, the dispensing conduit 124 nests within the central bore 138 and the sealing flanges 129 of the nozzle portion 120 nest within the slots 139 of the break-off cap 130. The sealing flanges 129 nesting within the slots 139 of the break-off cap 130 prohibits relative rotational movement between the nozzle portion 120 and the break-off cap 130. Furthermore, as noted above, the protrusion 153 of the nozzle portion 120 nests within the indent 151 of the break-off cap 130 in a mating fashion to prevent accidental axial separation of the break-off cap 130 from the nozzle portion 120.

Although the break-off cap 130 fits snugly onto the nozzle portion 120, a user is still able to repeatedly remove the break-off cap 130 from the nozzle portion 120 and replace the break-off cap 130 back onto the nozzle portion 120 for repeated use of the package 1000 for dispensing the fluidic product from the product cavity 111 and resealing/reclosing the dispensing conduit 124. Using the break-off cap 130 as a cap to close the previously opened package 1000 will prevent the fluidic product from being dispensed from the package 1000 and will also minimize the amount of air that enters into the product cavity 111. Thus, the break-off cap 130 also prevents the fluidic product, such as a toothpaste, from drying out.

Figure 9:
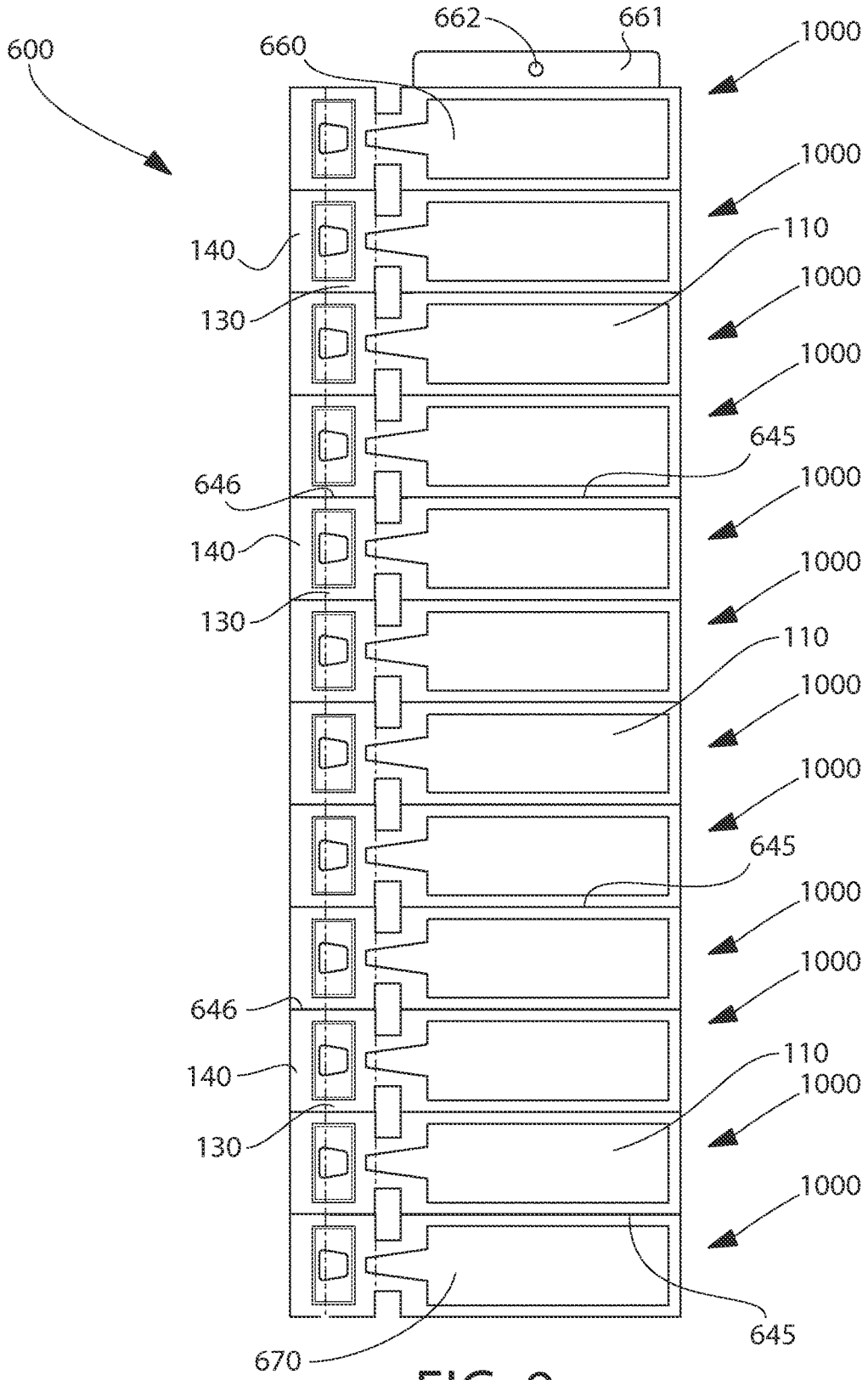
FIG. 9 is a multipack comprising a plurality of the packages of FIG. 1 detachably coupled together in an array or strip, wherein the packages can be separated from one another via manual force/tearing.

Referring now to FIG. 9, a toothpaste multipack 600 will be described in accordance with an embodiment of the present invention. The toothpaste multipack 600 comprises a plurality of the packages 1000 described herein above interconnected to form a longitudinal strip of the packages 1000. In the exemplified embodiment, twelve packages 1000 are included in the toothpaste multipack 600. Of course, the invention is not to be so limited and more or less than twelve packages 1000 can be used in a single toothpaste multipack 600 as desired. It should be understood that the specific details of the multipack 600 will be described below. However, each component/element will not be labeled on each of the packages 1000 and it should be understood that the components of each one of the packages 1000 are identical throughout the embodiment illustrated in FIG. 9. It should also be understood that while FIG. 9 illustrates a multipack 600 consisting of packages 1000, the multipack 600 may consist of packages 2000 (referring to FIG. 10) or packages 3000 (referring to FIG. 11).

In the toothpaste multipack 600, each of the packages 1000 are formed as described above as comprising the first laminate sheet 200 and the second laminate sheet 300 thermoformed together to form the unitary body 100. The unitary body 100 and the packages 1000 are the exact packages 1000 described above with reference to FIGS. 1-6 and include all of the portions discussed herein above with regard to the packages 1000.

In the toothpaste multipack 600, adjacent packages 1000 in the longitudinal strip are separated from one another by a first transverse pre-weakened area 645. Specifically, the first transverse pre-weakened area 645 is disposed between the product containing portions 110 of adjacent packages 1000. Additionally, the break-off caps 130 and covers 140 of adjacent ones of the packages 1000 are also connected to one another. In certain embodiments, the connection between the break-off caps 130 and covers 140 of adjacent packages are accomplished by a second transverse pre-weakened area 646. Furthermore, the toothpaste multipack 600 includes an upper-most package 660 and a lower-most package 670. The upper-most package 660 includes a sealing flange 661 having a hanger hole 662 formed therein for hanging the multipack 600 from a hook for retail display. It is contemplated that in some embodiments, the adjacent packages 1000 may be connected to one another only at the first transverse pre-weakened area 645, or the adjacent packages 1000 may be connected to one another only at the second transverse pre-weakened area 646.

As noted above, each of the packages 1000 in the multipack 600 are formed from the first laminate sheet 200 and the second laminate sheet 300 (FIGS. 7 and 8). However, in certain embodiments all of the packages 1000 in the longitudinal strip are formed from a single one of the first laminate sheet 200 and a single one of the second laminate sheet 300. In this way, an entire toothpaste multipack 600 can be formed in a single machining step whereby each of the packages 1000 of the multipack 100 has a one or two-step recloseable feature as has been described in detail herein above.

Figure 10:
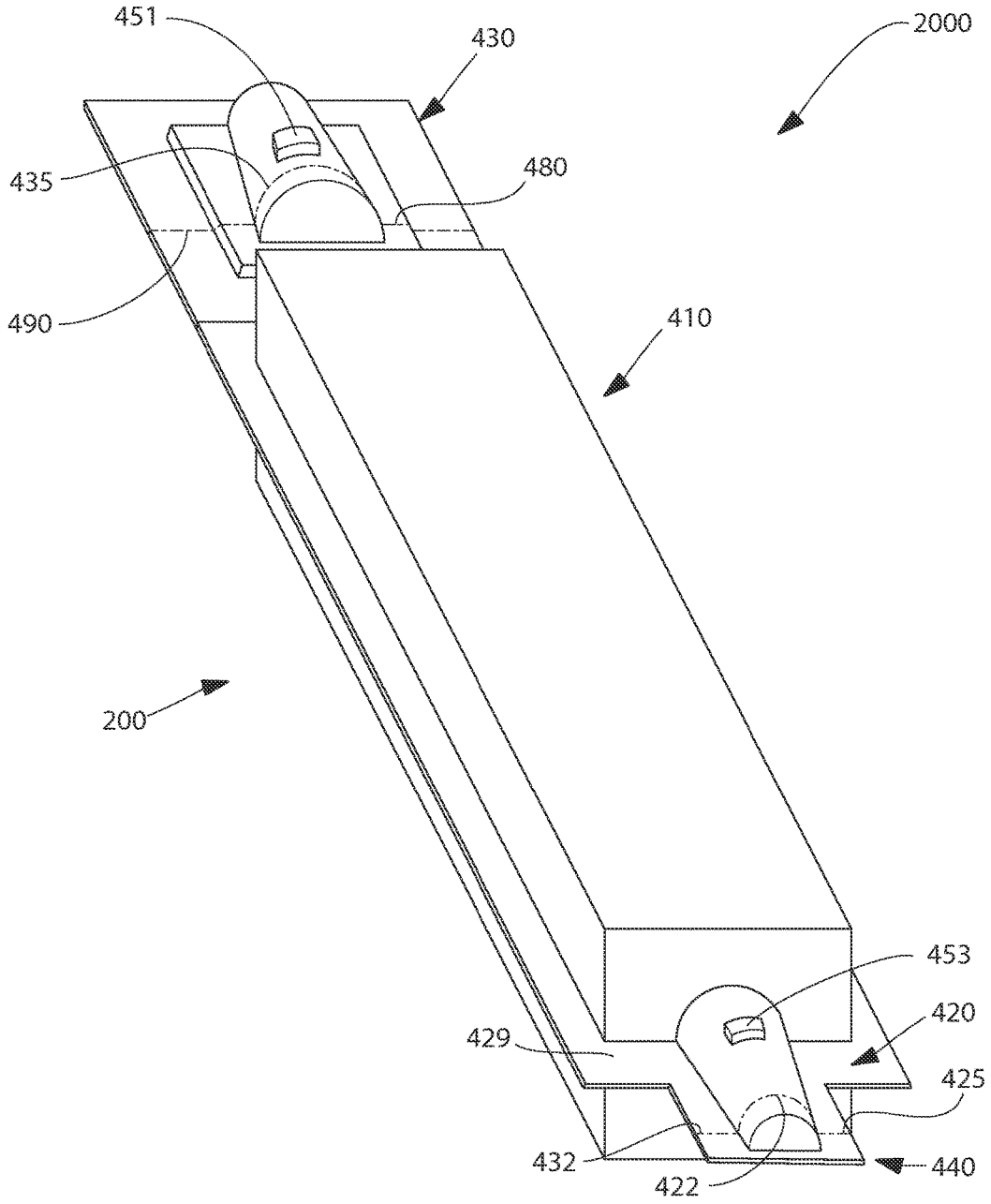
FIG. 10 is a perspective view of a package according to a first alternate embodiment of the present invention.

Turning to FIG. 10, a package 2000 will be described according to another embodiment of the present invention. The package 2000 is similar to the package 1000 with regard to many of the components described above. Therefore, the package 2000 will be described below using the same reference numbering scheme except that the 400-series of numbers will be used. Only those components and elements that are different from the components and elements of the package 1000 will be described in detail. As a general matter, it should be understood that the package 2000 also comprises a unitary body 400 that is formed from the first and second laminate sheets 200, 300 as has been described in detail above with reference to FIGS. 1, 7 and 8.

The unitary body 400 of the package 2000 generally comprises a product containing portion 410 having a product cavity containing a fluidic product, a nozzle portion 420 extending from the product containing portion 410 for dispensing the fluidic product from the product cavity, a first break-off cap 440 that seals a dispensing orifice of the nozzle portion 420 and a second break-off cap 430 that comprises a nozzle cavity having an insertion opening for slidably receiving the nozzle portion 420.

The unitary body 400 of the package 2000 also comprises a first pre-weakened area 425 and a second pre-weakened area 435. However, the locations of the pre-weakened areas 425, 435 and the break-off caps 430, 440 are different than the similar components from the package 1000. The first pre-weakened area 425 defines a top edge 422 of the nozzle portion 420 and a bottom edge 432 of the first break-off cap 440. Separation of the first break-off cap 440 from the nozzle portion 420 by tearing or cutting along the first pre-weakened area 425 exposes the dispensing orifice of the nozzle portion 420 and provides an outlet through which the product fluid can flow from the product cavity.

The second pre-weakened area 435 defines a bottom edge 480 of the product containing portion 410 and a top edge 490 of the second break-off cap 430. The attachment of the second break-off cap 430 to the bottom edge 480 of the product containing portion 410 does not seal any openings in the product containing portion 410 or the product cavity. Rather, the attachment of the second break-off cap 430 to the bottom edge 480 of the product containing portion 410 prevents any dust, debris and other contaminants from flowing into the nozzle cavity of the second break-off cap 430. Separation of the second break-off cap 430 from the product containing portion 410 results in the nozzle cavity and the insertion opening of the second break-off cap 440 being exposed.

Thus, the first break-off cap 440 is torn from the unitary body 400 at the first pre-weakened area 425 to enable a user to gain access to the fluidic product contained within the product cavity in the product containing portion 410. After removing the first break-off cap 440 from the unitary body 400, a user can squeeze the product containing portion 410 of the unitary body 400 to dispense the fluidic product therefrom. After a desired amount of the fluidic product has been dispensed, the user may tear the second break-off cap 430 from the unitary body 400 at the second pre-weakened area 435. Then, the second break-off cap 430 can be used in the same manner as the break-off cap 130 described above in FIGS. 1-6. Specifically, the second break-off cap 430 can include indents or protrusions 451 that mate with indents or protrusions 453 of the nozzle portion 420. The second break-off cap 430 can also include slots as described above with regard to the break-off cap 130 for engagement with flanges 429 of the nozzle portion 420. Thus, the second break-off cap 430 can be used to repeatedly close the dispensing orifice of the nozzle portion 420 to prevent the fluidic product from flowing out of the product cavity during non-use periods and re-open the dispensing orifice as desired.

Figure 11:
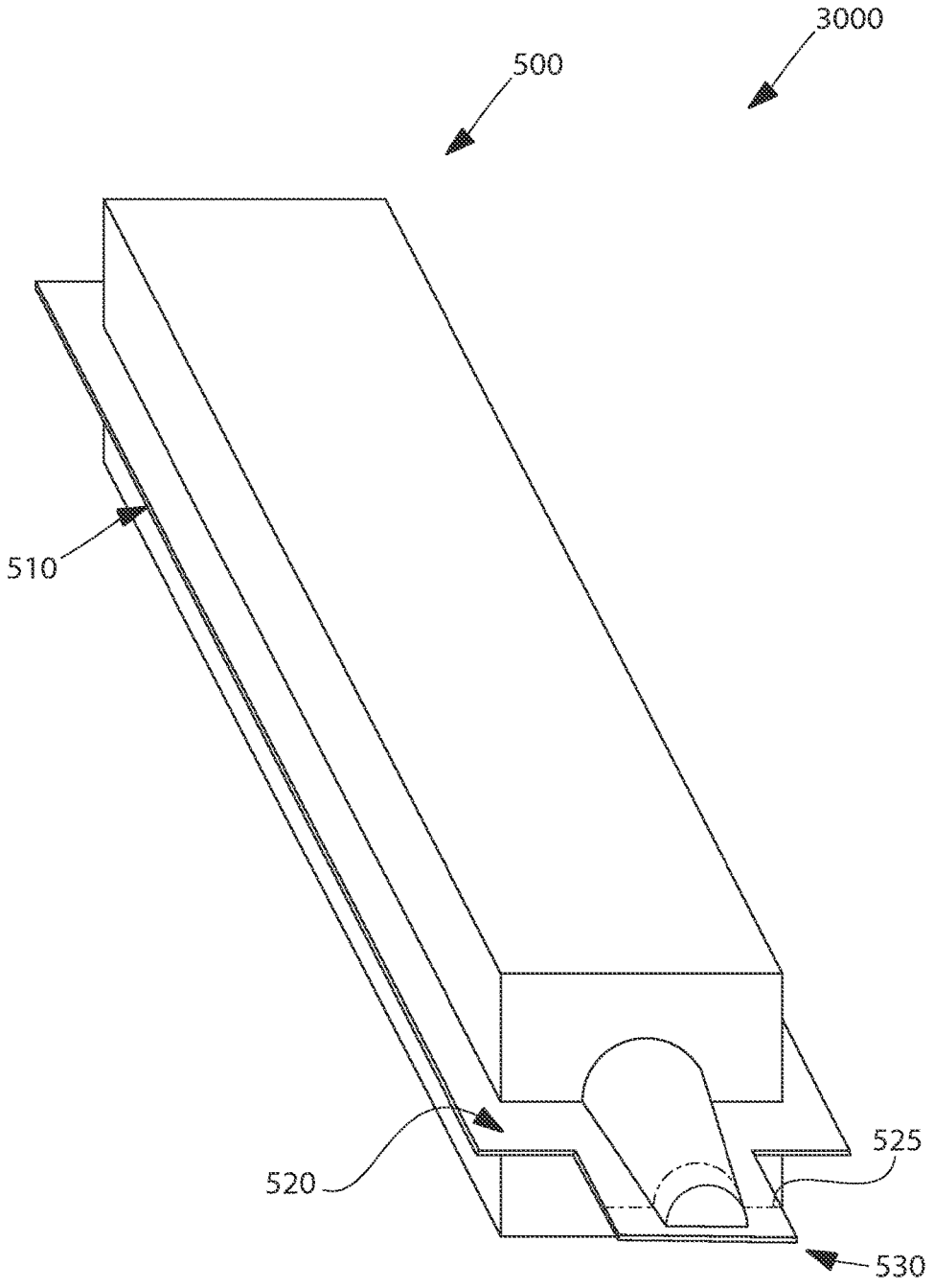
FIG. 11 is a perspective view of a package according to a second alternate embodiment of the present invention.

Referring now to FIG. 11, a package 3000 in accordance with yet another embodiment of the present invention will be described. The package 3000 is similar to the packages 1000, 2000 with regard to many of the components described above. Therefore, the package 3000 will be described below using the same reference numbering scheme except that the 500-series of numbers will be used. Only those components and elements that are different from the components and elements of the packages 1000, 2000 will be described in detail. As a general matter, it should be understood that the package 3000 also comprises a unitary body 500 that is formed from the first and second laminate sheets 200, 300 as has been described in detail above with reference to FIGS. 1, 7 and 8.

The unitary body 500 of the package 3000 comprises a product containing portion 510 having a product cavity containing toothpaste, a nozzle portion 520 for dispensing the toothpaste from the product cavity, and a break-off cap 530 that seals a dispensing orifice of the nozzle portion 520. It should be understood that the unitary body 500 of the package 3000 of toothpaste is also formed from the first and second laminate sheets 200, 300 as has been described in detail above with reference to FIGS. 1, 7 and 8. Thus, the unitary body 500 of the package 3000 is comprised of the first laminate sheet 200 and the second laminate sheet 300 thermoformed together to form the unitary body 500 such that the unitary body comprises the product containing portion 510 having a cavity containing toothpaste.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

What is claimed is:

1. A package comprising:

a first laminate sheet and a second laminate sheet coupled together to form a unitary body, the unitary body comprising a product containing portion having a product cavity containing an oral care fluidic product and a sealing flange along the periphery of the unitary body to seal the unitary body;

wherein each of the first and second laminate sheets comprises an inner layer of polyethylene (PE) and an outer layer of polyethylene terephthalate (PET), and wherein the inner layer of PE has a first thickness in a range of 15 to 500 microns and the outer layer of PET has a second thickness in a range of 10 to 200 microns, the second thickness being less than the first thickness, wherein a ratio of the first thickness to the second thickness is in a range of 2:1 to 4:1 further comprising: a nozzle portion defining a dispensing conduit for dispensing the oral care fluidic product from the product cavity; and a break-off cap defining a nozzle cavity for sealing a dispensing orifice of the nozzle portion, wherein the sealing flange comprises a product containing portion sealing flange, a nozzle portion sealing flange, and a break-off cap sealing flanges to seal the product cavity, the dispensing conduit of the nozzle portion, and the nozzle cavity of the break-off cap; and further comprising: a first pre-weakened area in the unitary body that defines a top edge of the nozzle portion and a bottom edge of the break-off cap, wherein the dispensing conduit extends from the product cavity to a location beyond the first pre-weakened area; and wherein upon the break-off cap being separated from the nozzle portion along the first pre-weakened area, the dispensing orifice becomes exposed.

2. The package according to claim 1 wherein the first thickness is about 50 microns.

3. The package according to claim 1, wherein the ratio of the first thickness to the second thickness is about 3:1.

4. The package according to claim 1 wherein the product containing portion contains 0.1 mL to 50.0 mL of the oral care fluidic product.

5. The package according to claim 1 wherein the inner layer of PE and the outer layer of PET for each of the first and second laminate sheets are coupled together via an adhesive.

6. The package according to claim 1 wherein for each of the first and second laminate sheets, the inner layer of PE is bonded directly to the outer layer of PET.

7. The package according to claim 1, wherein:

the nozzle cavity has an insertion opening for slidably receiving the nozzle portion to reseal the dispensing orifice after the break-off cap has been separated from the nozzle portion along the first pre-weakened area;

the unitary body further comprising a cover that seals the insertion opening and a second pre-weakened area that defines a top edge of the break-off cap and a bottom edge of the cover; and upon the cover being separated from the break-off cap along the second pre-weakened area, the insertion opening becomes exposed.

8. The package according to claim 1, wherein, the sealing flanges of the product containing portion, the nozzle portion and the break-off cap collectively seal the product cavity and a dispensing conduit of the nozzle portion.

9. The package according to claim 1 wherein the inner layer of PE of the first and second laminate sheets is thermally fused to the outer layer of PET of the first and second laminate.

10. The package according to claim 1 wherein each of the first and second laminate sheets comprises a tie layer disposed between and coupling the inner layer of PE and the outer layer of PET.

11. The package according to claim 10 wherein the tie layer is formed of a material selected from a group consisting of ethylene acrylic acid, anhydride modified ethylene acrylate adhesive resin, a copolymer of ethylene and methacrylic acid, ethylene ethyl acrylate copolymer, modified polyethylene, modified polyolefin, ionomers, and methacrylic acid modified polyethylene.

12. The package according to claim 10 wherein the tie layer has a third thickness that is in a range of 5 to 30 microns.

* * * * *